US011756750B2

(12) United States Patent
Mattarelli

(10) Patent No.: US 11,756,750 B2
(45) Date of Patent: Sep. 12, 2023

(54) DISCONNECTOR, PARTICULARLY FOR PHOTOVOLTAIC APPLICATIONS

(71) Applicant: BREMAS ERSCE S.P.A., Cambiago (IT)

(72) Inventor: Andrea Mattarelli, Verona (IT)

(73) Assignee: BREMAS ERSCE S.P.A., Cambiago (IT)

( * ) Notice: Subject to any disclaimer, the term of this patent is extended or adjusted under 35 U.S.C. 154(b) by 0 days.

(21) Appl. No.: 17/587,878

(22) Filed: Jan. 28, 2022

(65) Prior Publication Data

US 2023/0033155 A1 Feb. 2, 2023

(30) Foreign Application Priority Data

Jul. 29, 2021 (IT) ..... 102021000020222

(51) Int. Cl.
*H01H 1/36* (2006.01)
*H01H 3/46* (2006.01)
(Continued)

(52) U.S. Cl.
CPC ..... *H01H 9/26* (2013.01); *H01H 3/46* (2013.01); *H01H 3/50* (2013.01); *H01H 9/02* (2013.01); *H01H 1/365* (2013.01)

(58) Field of Classification Search
CPC ..... H01H 19/14; H01H 19/115; H01H 19/36; H01H 19/04; H01H 19/08; H01H 19/10;
(Continued)

(56) References Cited

U.S. PATENT DOCUMENTS 4,861,949 A * 8/1989 Bortolloni ..... H01H 19/03 200/5 R
5,721,449 A * 2/1998 Panuce ..... H01H 19/64 257/466
(Continued)

FOREIGN PATENT DOCUMENTS

DE 1058123 B 5/1959
DE 3542399 A1 6/1987
(Continued)

OTHER PUBLICATIONS

EP Extended Search Report dated Jun. 3, 2022 re: Application No. 21217810.7-1201, pp. 1-8, citing: WO 2017/202720 A1, WO 2013/079091 A1 and DE 35 42 399 A1.

*Primary Examiner* — William A Bolton
(74) *Attorney, Agent, or Firm* — CANTOR COLBURN LLP

(57) ABSTRACT

A disconnector having a stack of modular contact boxes surmounted by a snap-action switch box, each modular contact box including a rotary contact and two fixed contacts which are accessible from the outside. The switch box further includes a driven indexing element which is rotatably associated with a spindle loading support and at least one spring connected between the two in order to load them elastically with respect to each other following a mutual rotation about the central axis. The disconnector has a single actuation rod which passes through all the modular contact boxes coaxially to the central axis and is fixed in rotation to all the rotary contacts.

11 Claims, 18 Drawing Sheets

(51) Int. Cl.
*H01H 3/50* (2006.01)
*H01H 9/02* (2006.01)
*H01H 9/26* (2006.01)

(58) Field of Classification Search
CPC ..... H01H 19/64; H01H 19/24; H01H 9/26; H01H 9/02; H01H 3/46; H01H 3/50; H01H 1/365; H01H 1/42; H01H 5/14; H01H 5/16; H01H 1/2041
USPC ..... 200/5 R, 293, 11 A, 570
See application file for complete search history.

(56) References Cited

U.S. PATENT DOCUMENTS

| | | | | |
|---|---|---|---|---|
| 5,967,304 | A * | 10/1999 | MacKay | H01H 19/56 200/11 R |
| 8,658,923 | B2 * | 2/2014 | Weber | H01H 1/2041 200/11 TC |
| 9,734,957 | B2 * | 8/2017 | Civettini | H01H 19/08 |
| 10,930,453 | B2 * | 2/2021 | Hoogvliet | H01H 19/08 |
| 2020/0321172 | A1 * | 10/2020 | Mattarelli | H01H 19/08 |

FOREIGN PATENT DOCUMENTS

| | | | |
|---|---|---|---|
| EP | 2853012 | B1 | 7/2017 |
| GB | 1159729 | A | 7/1969 |
| WO | 2013079091 | A1 | 6/2013 |
| WO | 2017202720 | A1 | 11/2017 |

* cited by examiner

DISCONNECTOR, PARTICULARLY FOR PHOTOVOLTAIC APPLICATIONS

CROSS-REFERENCE TO RELATED APPLICATIONS

This application is related to and claims the benefit of Italian Patent Application No. 102021000020222, filed on Jul. 29, 2021, the contents of which are herein incorporated by reference in their entirety.

TECHNICAL FIELD

The present disclosure relates to a disconnector, particularly for photovoltaic applications.

BACKGROUND

In photovoltaic systems, the currents produced by the individual photovoltaic cells are combined in order to reach the current and the total power needed by the utilization system. In a photovoltaic system, the photovoltaic cells, the photovoltaic modules that comprise them and the strings of these photovoltaic modules can be protected, or disconnected, using DC disconnectors, which are rotary switches that can be actuated by hand.

Conventional disconnectors are described in European patent EP2853012B1 in the name of the same applicant and are formed by a plurality of modular contact boxes which are substantially identical and stacked on each other. Each contact box, also called a module or layer, generally comprises a rotary contact and a pair of fixed contacts. The grouped rotation of the rotary contacts makes it possible, in an extremely short time, to cut off or to allow the flow of current between the two fixed contacts in each contact box.

The rotation is imposed manually through a snap-action switch box, which is placed at the top of the stack of contact boxes and comprises a handle that can be operated by the user. The rotation imparted by the handle is progressively transmitted from one rotary contact directly to the one immediately underneath by snap action, by virtue of a shape coupling between the rotary contacts. This shape coupling is obtained by having, on one face of the rotary contact, a contoured central pin and, on the other face, a central seat shaped complementarily to the pin and adapted to receive the contoured pin of the rotary contact of the contiguous layer in order to transmit the rotation.

One problem with these conventional disconnectors is that it is not possible to ensure the simultaneity of the opening and closing of the contacts, because the mechanical plays between one rotary contact and the one contiguous to it are summed together, and the rotary contacts of the deeper layers respond less quickly to the rotation imparted by the rotary contact nearest to the snap-action switch box. These response delays do not allow to to have a DC disconnector with a number of layers or circuits higher than a certain limit, because it would not be capable of passing the safety tests specified by some current regulations such as for example the IEC 60947-3 standard (test sequence III: "Short-circuit performance capability").

For this reason, with the conventional structure described above in which the rotary contacts transmit the rotation directly from one to the next through a mutual shape coupling, it has been found that it is not possible to pass the above mentioned tests with a DC disconnector with more than 8 layers.

In addition, in DC disconnectors for high power levels, in which some positive contacts are arranged in series in each circuit of the disconnector, it is not possible to have more than three circuits in the same disconnector.

Another drawback is that, with the snap-action switch box in conventional disconnectors, such as for example those described in patent applications nos. DE1058123 or GB1159729, a metal lamina locking spring is used. If it is desired to reduce the metal components of this conventional structure, by replacing the lamina with an elastic element made of plastic, the resulting structure could pass the mechanical tests according to the IEC 60947-3 standard (test sequence II: "Operational performance capability") in an unencumbered area, but those tests might not be passed in a climate chamber at high temperatures and with high levels of humidity, owing to the wear of the plastic components in contact with each other. This is a significant drawback, since the preferred use of the DC disconnector is in the photovoltaic sector and therefore it occurs in environments that can have high temperatures and high levels of humidity.

SUMMARY

The aim of the present disclosure is to provide a disconnector that is capable of improving the known art in one or more of the above mentioned aspects.

Within this aim, the disclosure provides a DC disconnector that is adapted to pass the safety test even with a large number of modules or layers, for example with 12 layers.

The disclosure improves the simultaneity of rotation of the rotary contacts of the disconnector, by reducing the rotation delays that characterize the rotary contacts of the layers that are further from the snap-action switch box and which, in the known art, increase instead when the number of modules of the disconnector increases.

The disclosure also provides a disconnector wherein the snap-action switch box has a reduced number of metallic elements compared to conventional snap-action switch boxes and is adapted to operate reliably even at high temperatures and at high levels of humidity.

The disclosure further provides a DC disconnector that is capable of passing the IEC 60947-3 tests, in particular the "Test sequence III", even with more than 8 layers or modules and even in those cases where, in order to have a higher voltage for the same amperage, the positive poles of some adjacent modules are connected to each other in series.

The disclosure provides a disconnector so as to simplify its maintenance or updating.

Furthermore, the present disclosure sets out to overcome the drawbacks of the background art in a manner that is alternative to any existing solutions.

The disclosure also provides a disconnector that is highly reliable, easy to implement and of low cost.

This aim and these and other advantages which will become better apparent hereinafter are achieved by providing a disconnector according to claim 1, optionally provided with one or more of the characteristics of the dependent claims.

The aim and the advantages of the disclosure are likewise achieved by a disconnector according to claim 7, optionally provided with one or more of the characteristics of the dependent claims.

BRIEF DESCRIPTION OF THE DRAWINGS

Further characteristics and advantages of the disclosure will become better apparent from the description of preferred, but not exclusive, embodiments of the disconnector according to the disclosure, which are illustrated by way of non-limiting example in the accompanying drawings wherein.

DETAILED DESCRIPTION OF THE DRAWINGS

Figure 1:
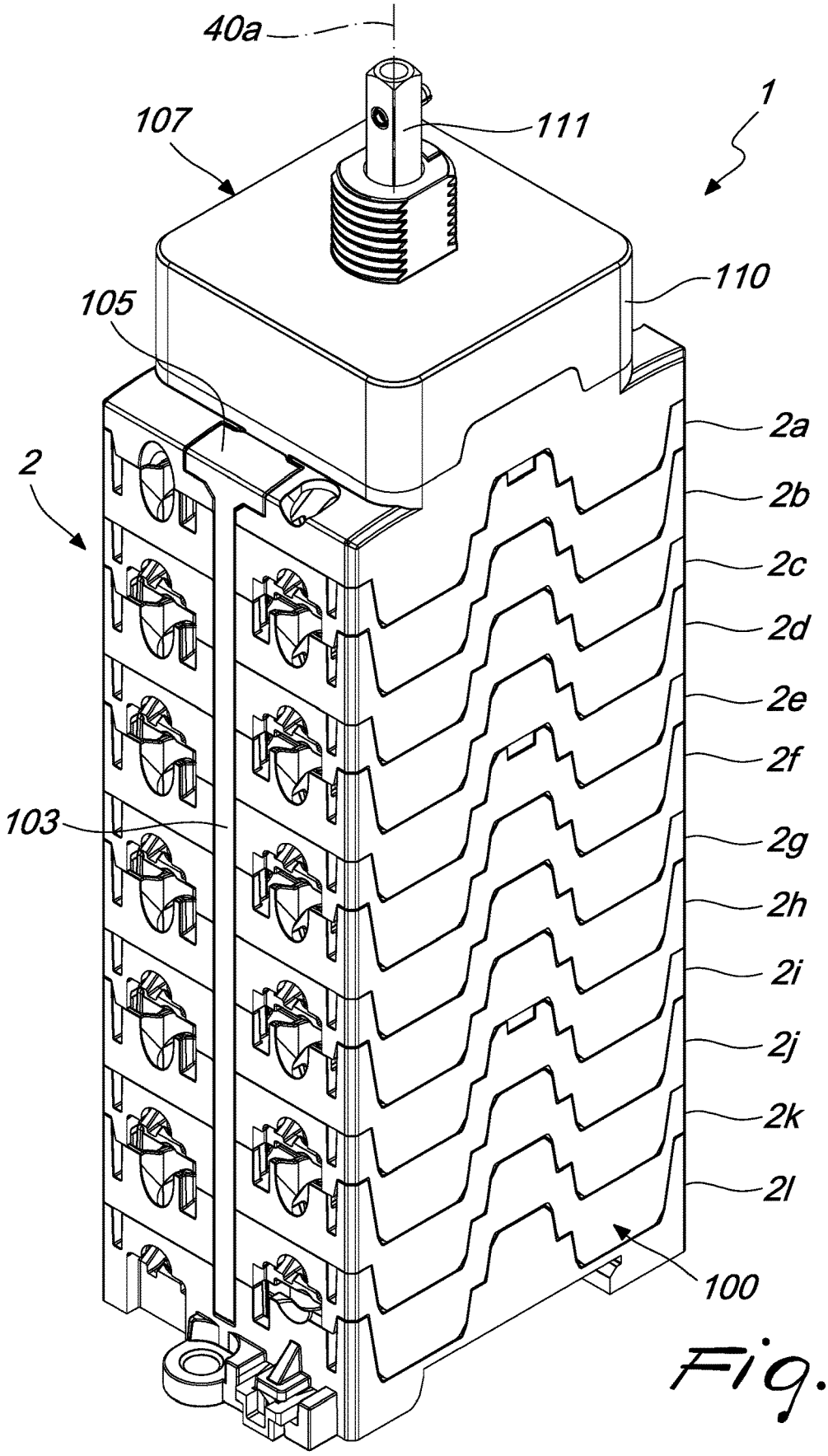
FIG. 1 shows an embodiment of the disconnector according to the disclosure.
Figure 2:
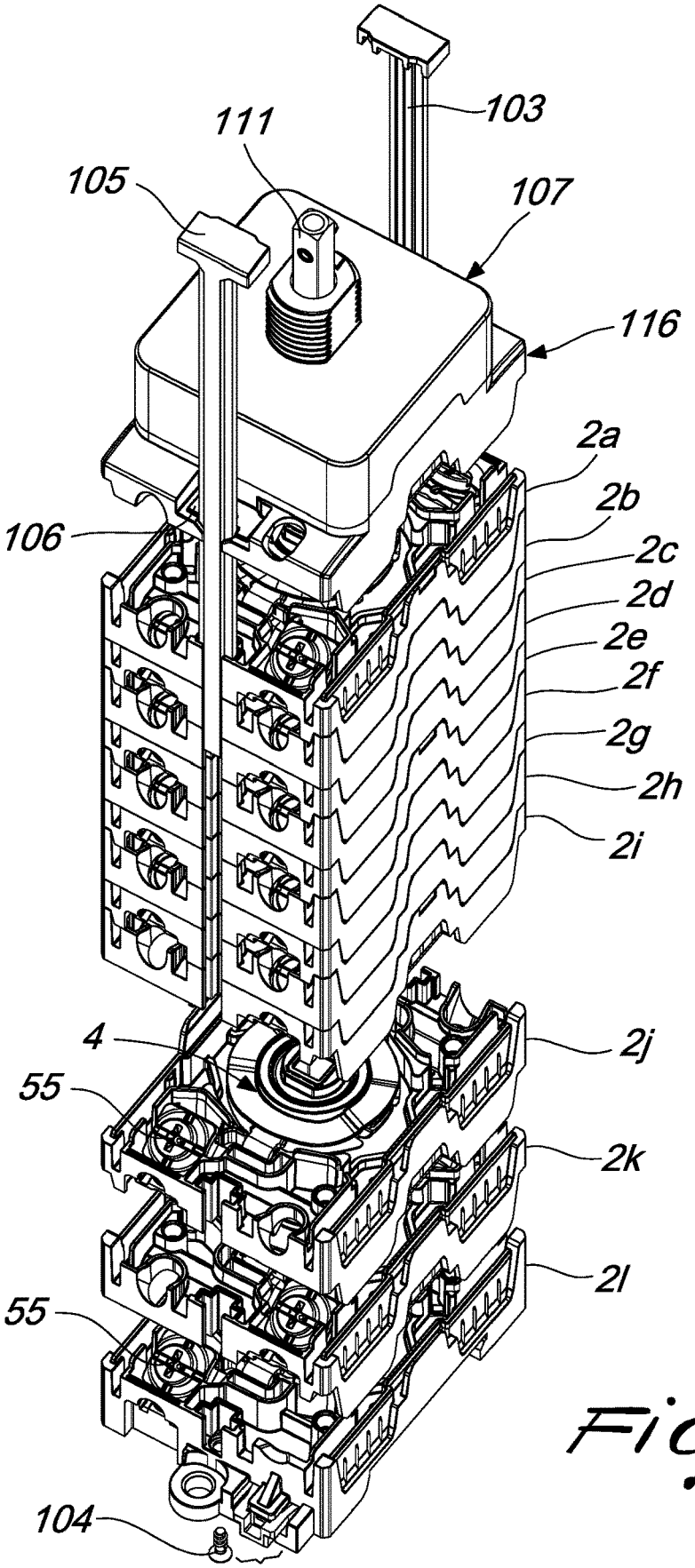
FIG. 2 is a partially exploded view of the disconnector of FIG. 1.
Figure 3:
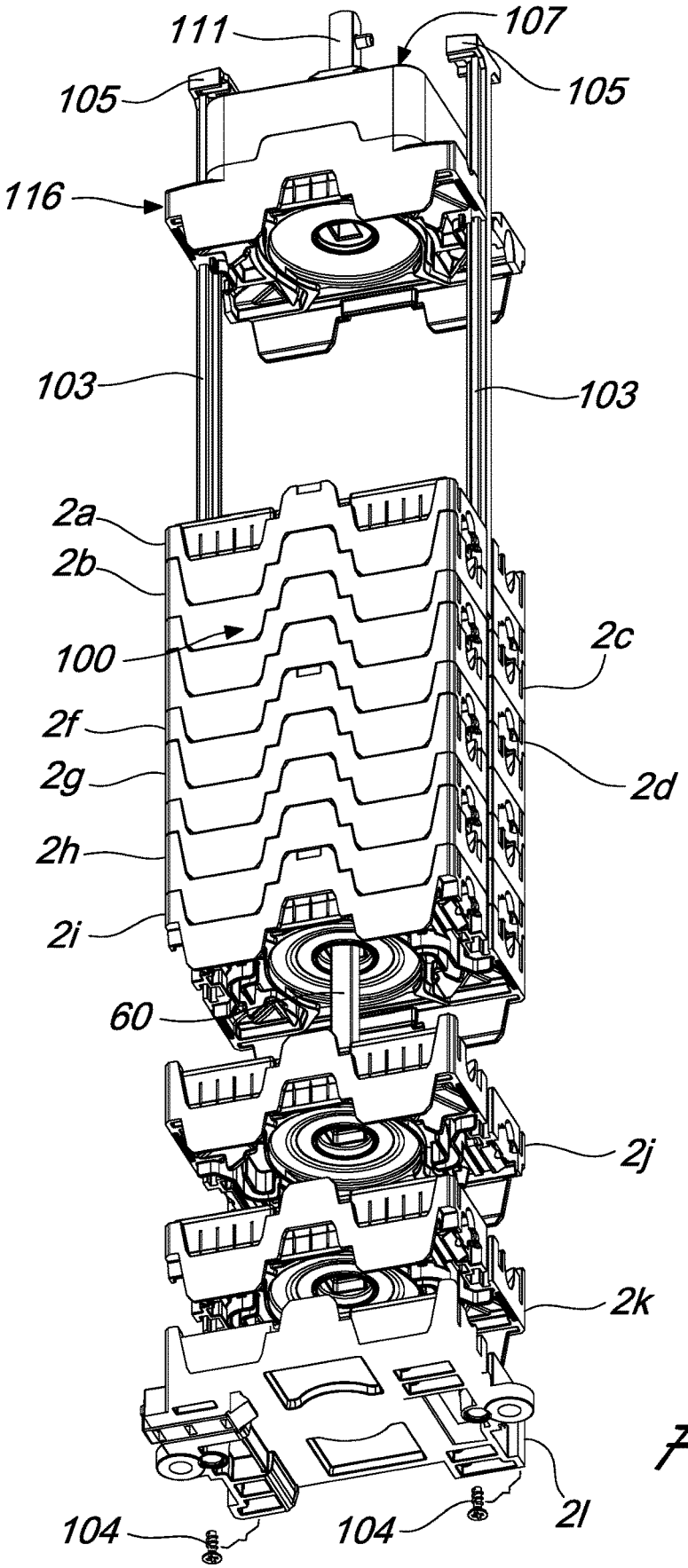
FIG. 3 is a view of the exploded disconnector of the previous figure, from a different perspective.
Figure 4:
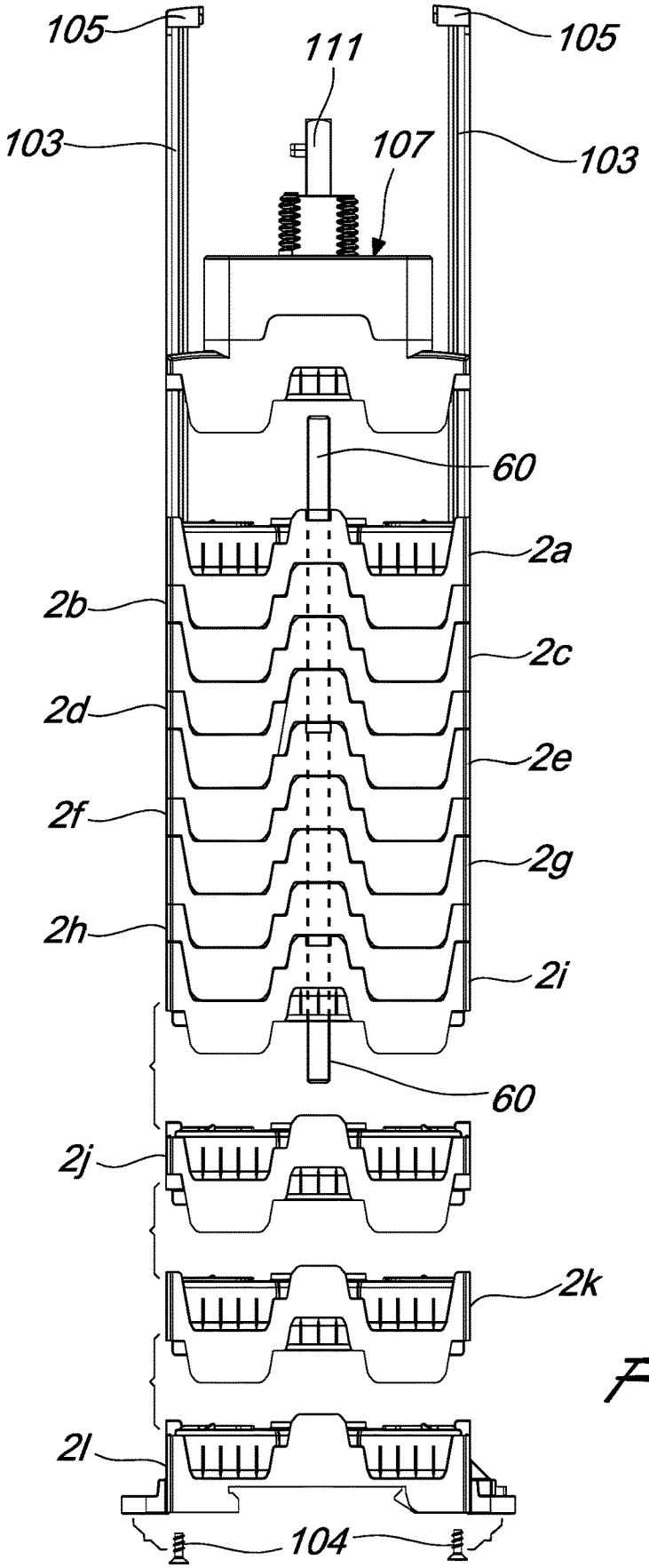
FIG. 4 is a side view of the exploded view of FIGS. 2 and 3.

With reference to the figures, a DC disconnector according to an embodiment of the disclosure, particularly for photovoltaic applications, is generally designated by the reference numeral 1 and comprises a stack 2 of modular contact boxes which is surmounted by a snap-action switch box 107. The stack 2 can have a substantially prismatic shape, for example substantially parallelepiped.

In the example shown, the modular contact boxes stacked one on top of the other are twelve in number and are indicated with 2*a*, 2*b*, 2*c*, 2*d*, 2*e*, 2*f*, 2*g*, 2*h*, 2*i*, 2*j*, 2*k*, 2*l*. The number of modular contact boxes of the disconnector 1 according to the disclosure can, however, be any number, for example a number comprised between 2 and 12 modular contact boxes, but more preferably comprising a high number of modular contact boxes like those illustrated, for example at least 6 or, even more preferably, at least 8, 10 or 12 modular contact boxes.

The modules 2*a*-21 are preferably identical to each other, except for optionally the last module 21 of the stack 2, which is the furthest from the snap-action switch box 107 and can be externally contoured differently, for example with fixing lugs and/or other elements for mounting on external support structures.

The disconnector 1 can, furthermore, comprise means for fastening the modular contact boxes 2*a*-21, each one of which comprises a tie rod 103, made of plastic, or of suitably insulated metal, and passes through each modular contact box 2*a*-21 of the stack 2. The tie rod 103 comprises, at a first end, two grip wings 105 that engage with a seat 106 provided in the snap-action switch box 107 of the disconnector 1, and, at a second end, a threaded hole for the insertion of a securing screw 104 that passes through, for example, the above mentioned lugs of the last contact box 21, or which in any case passes through the base portion of the disconnector 1.

Considering, for the sake of simplicity of explanation, that the modules 2*a*-21 are identical to each other, each one of them comprises an accommodation body 3 (FIGS. 19-20), which can be polygonal in plan view, for example quadrangular in plan view, as in the case shown, wherein the outer plan is substantially rectangular.

Each accommodation body 3, made of electrically insulating material, for example of molded polymeric material, is axially contoured along at least two peripheral edges 32 and 34 of its upper and lower faces, so that such edges 32 and 34 have a mutually complementary shape and enable a coupling with the accommodation body 3 of a contiguous module arranged immediately above or immediately below in the stack 2, while preventing a mutual rotation and a relative radial translation. In the embodiment illustrated, the edges 32 and 34 have a substantially wave-like shape.

In the preferred embodiment of the disclosure, the coupling between the edges of two consecutive accommodation bodies 3 is axially removable, i.e. the two accommodation bodies are not fixed to each other in the axial direction by the coupling of the edges alone.

The accommodation body 3 defines a through central seat 40, for a rotary contact 4, and two peripheral seats 50, each one of which accommodates a connection portion 51 of a fixed contact 5, which can be accessed from outside the modular contact box 2*a*-21. The rotary contact 4 can rotate about a central axis 40*a* of the central seat 40 relative to the accommodation body 3, in order to engage, only in predefined angular positions, with the fixed contacts 5, which are arranged with the connection portion 51 thereof in the peripheral seats 50.

The accommodation body 3, together with the rotary contact 4 and the fixed contacts 50, defines the (modular) contact box 2*a*, 2*b*, . . . , herein also referred to as a "module" or "layer".

The two peripheral seats 50 of a same accommodation body 3 are arranged on a same side with respect to an ideal central plane A that passes through the axis 40*a*, which is preferably also the central plane of the stack 2 and of the disconnector 1. Furthermore, in the stack 2 of the disconnector 1 the two peripheral seats 50 of an accommodation body 3 and the two peripheral seats 50 of each contiguous (i e immediately above or below) accommodation body 3 are arranged on mutually opposite sides with respect to the ideal central plane A.

In the illustrated case of an accommodation body 3 that is substantially rectangular in plan, the central seat 40 passes through the two opposite faces of the accommodation body 3 and the ideal central plane A mentioned above is parallel to the two opposite sides 30, 31 of the accommodation body 3.

In the stack 2 of the disconnector 1, the peripheral seats 50 that accommodate the fixed contacts 5 are arranged, for each modular contact box 2*a*-21, alternately proximate to the side 100 and to the opposite side 101 of the disconnector 1 respectively.

Each fixed contact 5 comprises a connection portion 51, a contact portion 52, and a connecting portion 53 that extends between the connection portion 51 and the contact portion 52.

The contact portion 52 of the fixed contact 5 is adapted to establish an electrical contact with the rotary contact 4. In particular, the contact portions 52 of the fixed contacts 5 can be advantageously arranged at the ideal central plane A.

The connection portion 51 can be accessed from outside the modular contact box 2*a*-21, and from outside the disconnector 1. This connection portion 51 in fact can comprise a screw tightening system 55, for tightening and connecting the connection portion to an external electrical conductor (or cable).

In an alternative embodiment, not shown, in each modular contact box it is possible to use, instead of the illustrated screw tightening system 55, a cage clamp, per se conventional, particularly if the external electric conductors to be connected are high-amperage, for example over 100 A.

Figure 5:
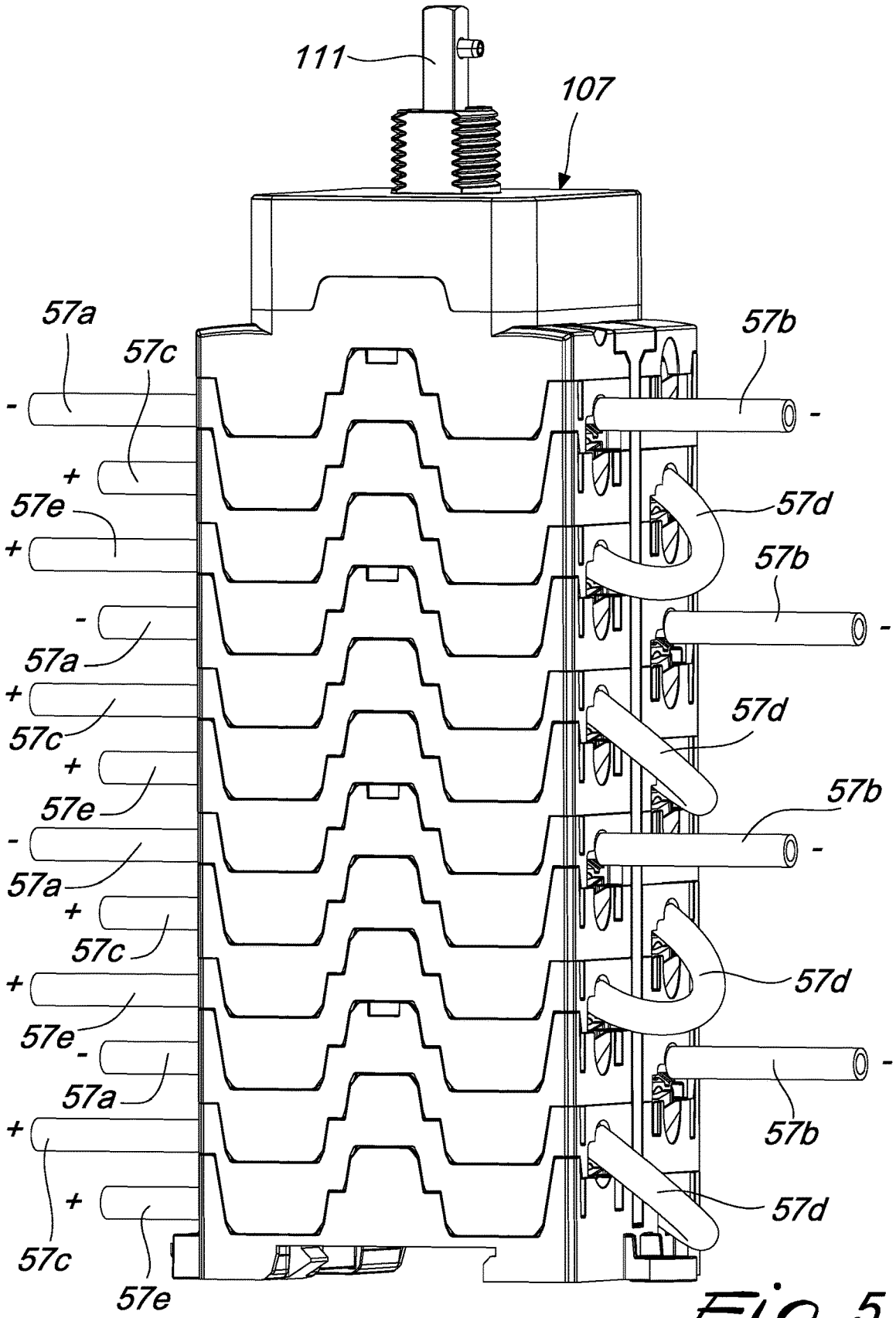
FIG. 5 shows the disconnector of FIG. 1 with a first configuration of the circuits.
Figure 6:
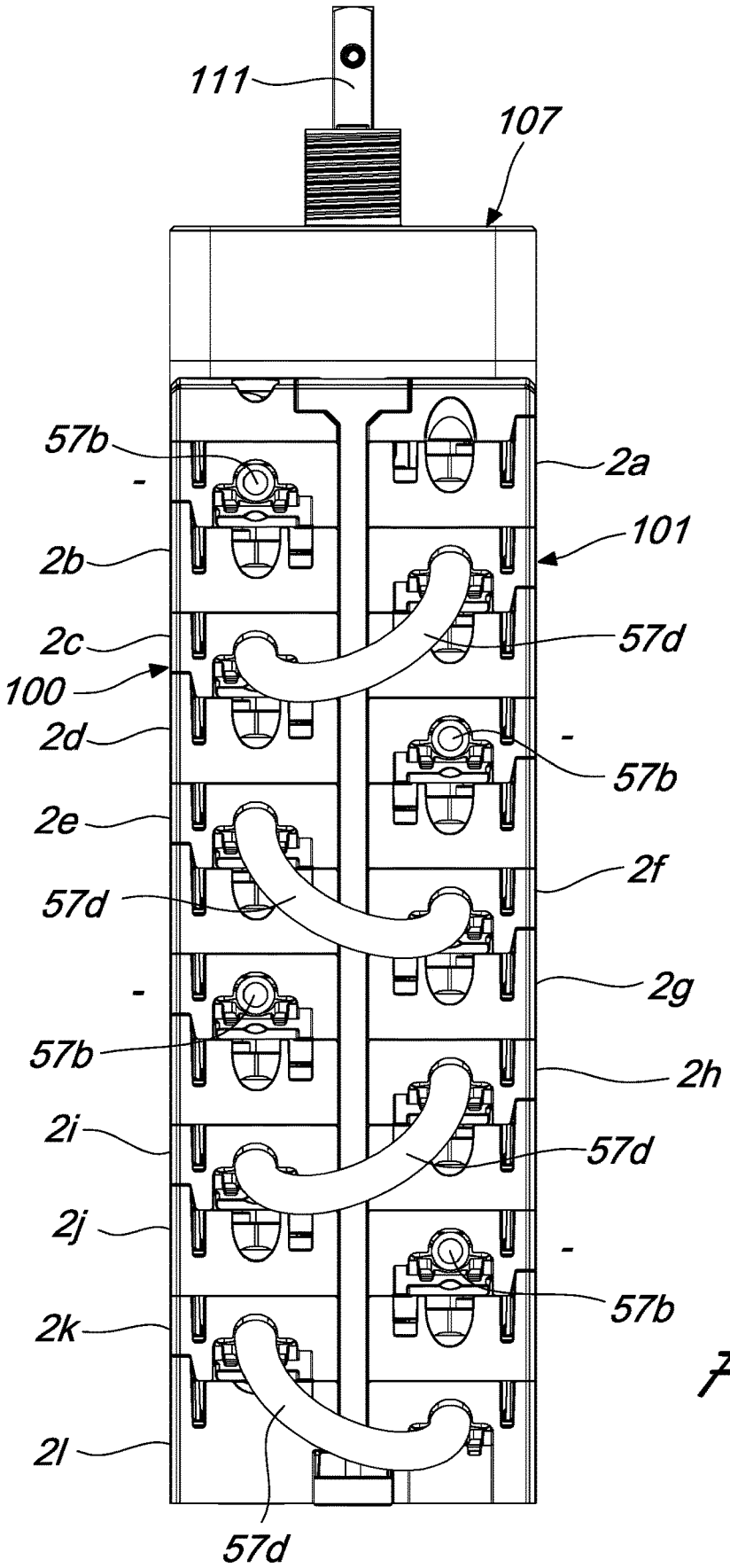
FIG. 6 is a side view of the disconnector of the previous figure.
Figure 7A:
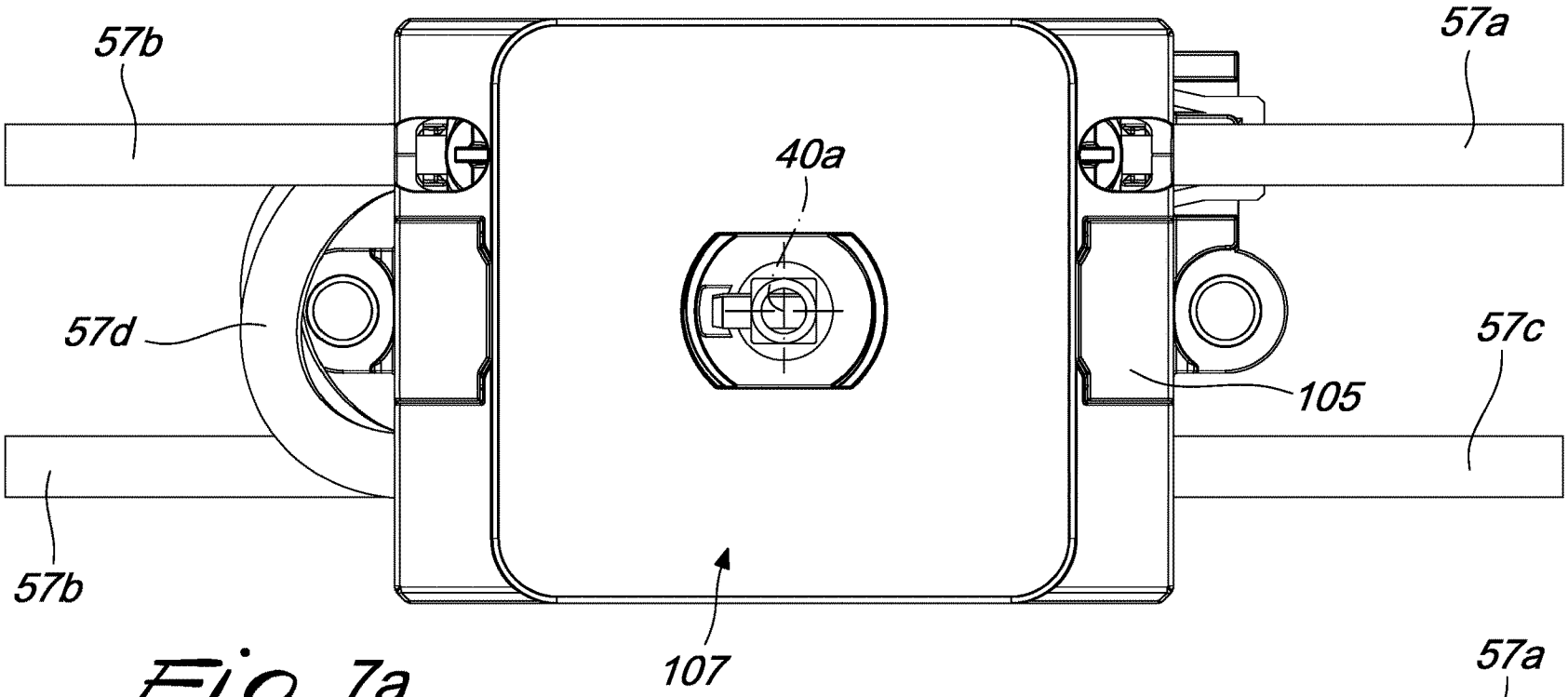
FIG. 7*a* is a plan view from above of the disconnector of FIG. 5.
Figure 7B:
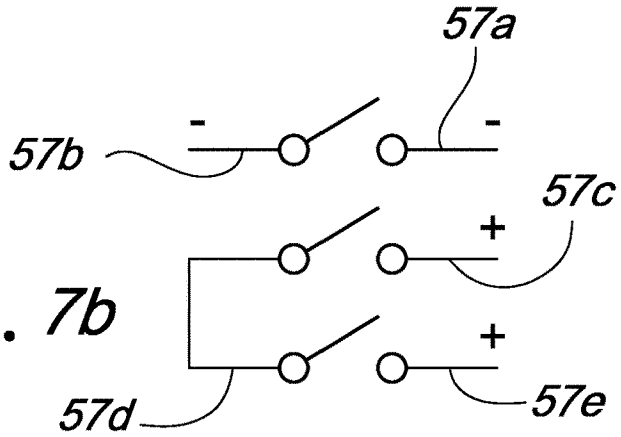
FIG. 7*b* is an electrical diagram of each circuit of the disconnector of the previous figure.
Figure 8:
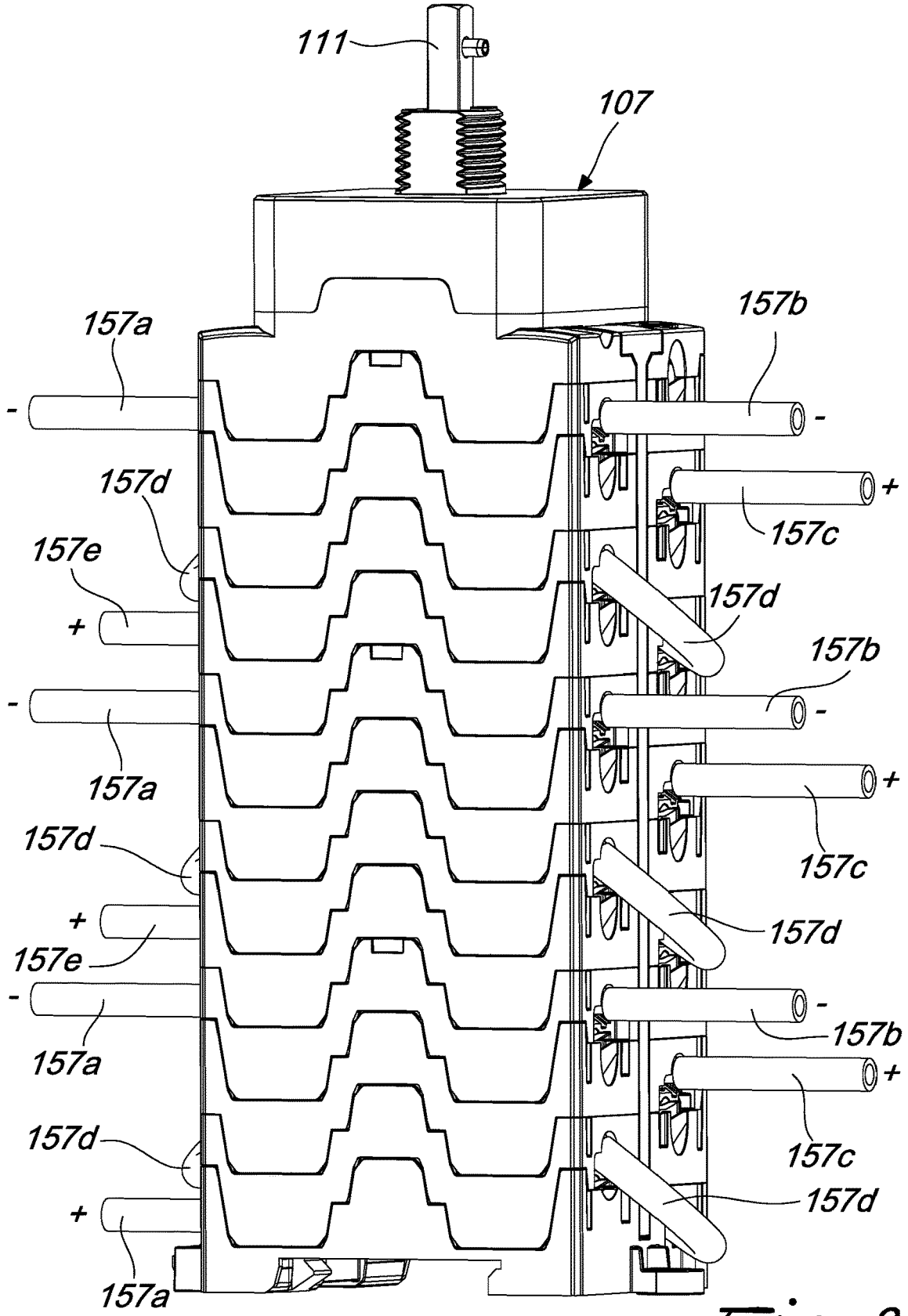
FIG. 8 shows the disconnector of FIG. 1 with a second configuration of the circuits.
Figure 9:
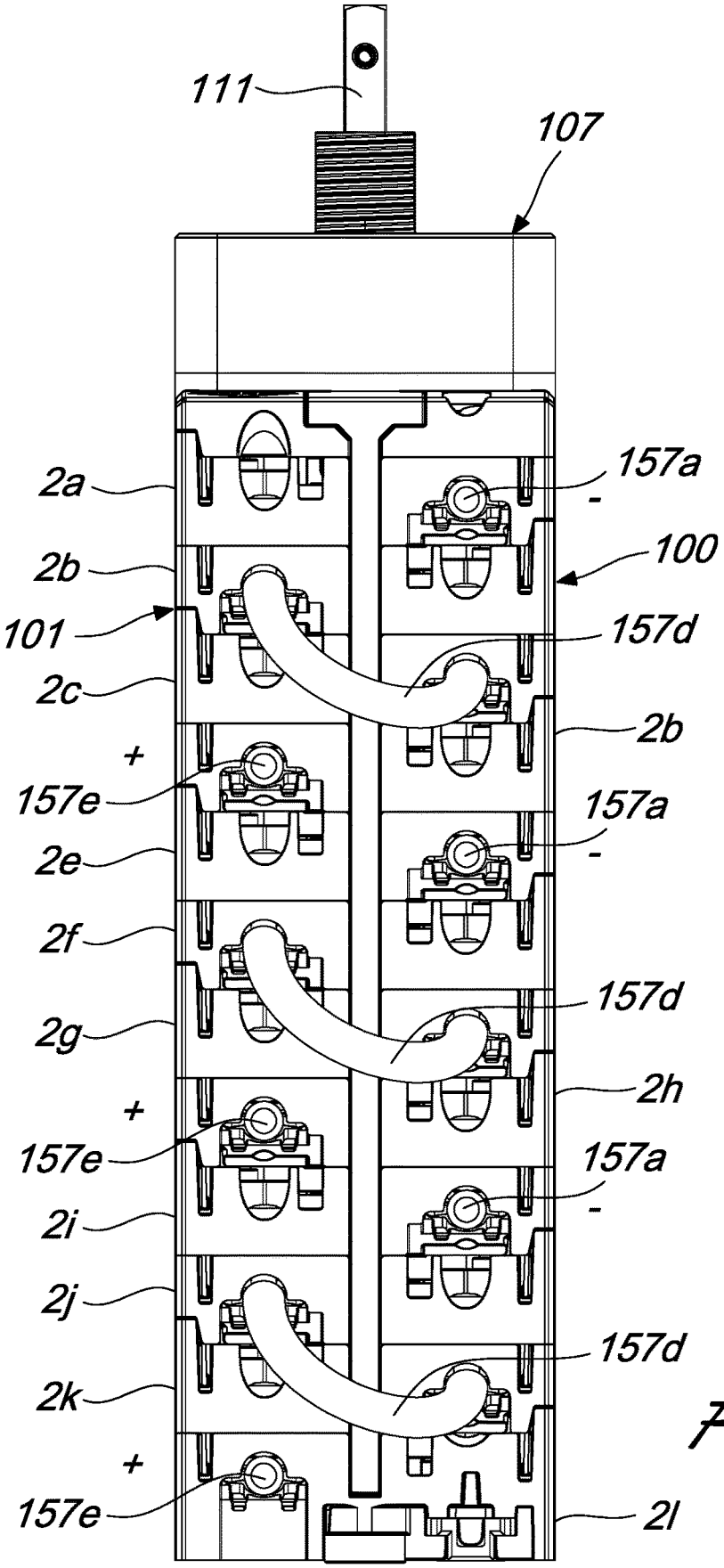
FIG. 9 is a first side view of the disconnector of the previous figure.
Figure 10:
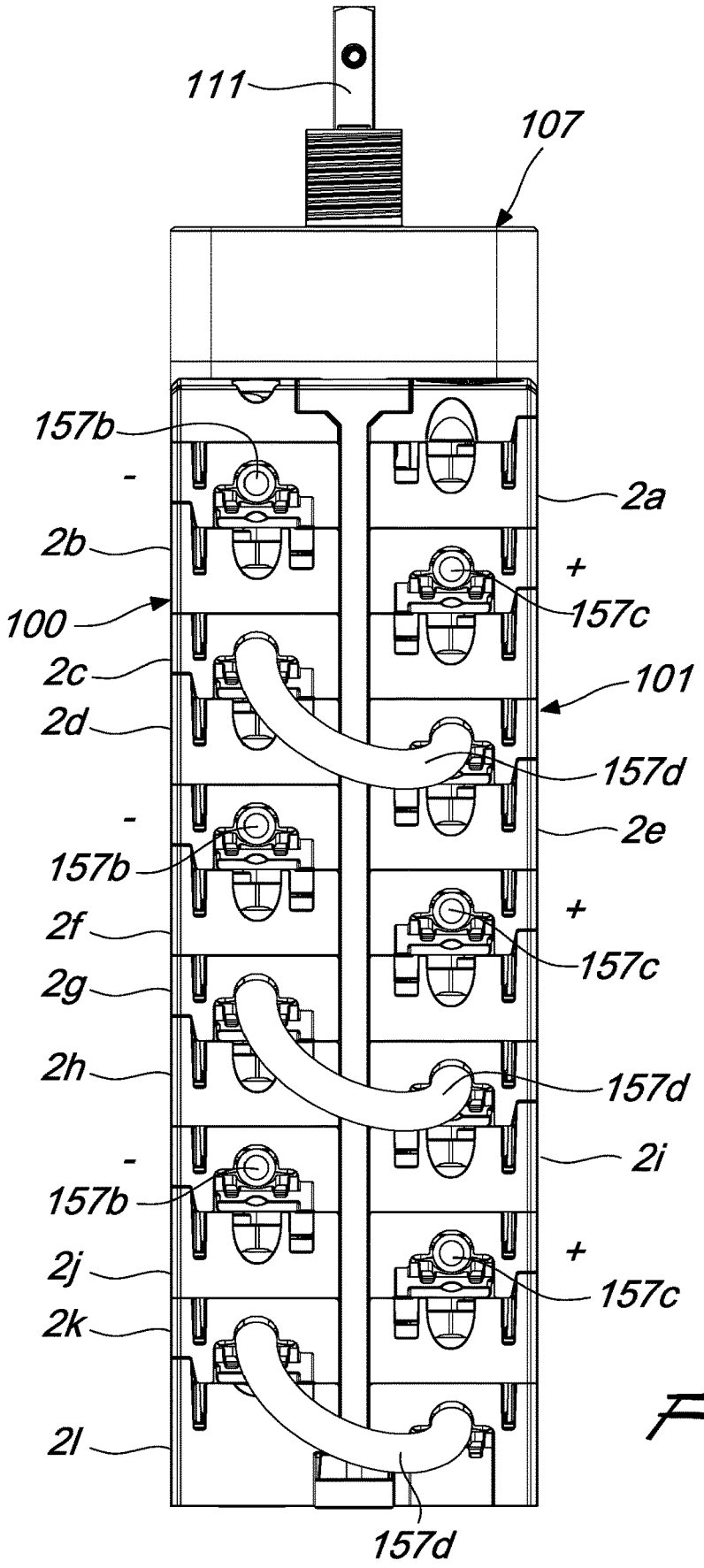
FIG. 10 is a second side view of the disconnector of FIG. 8, from the other side with respect to FIG. 9.
Figure 11A:
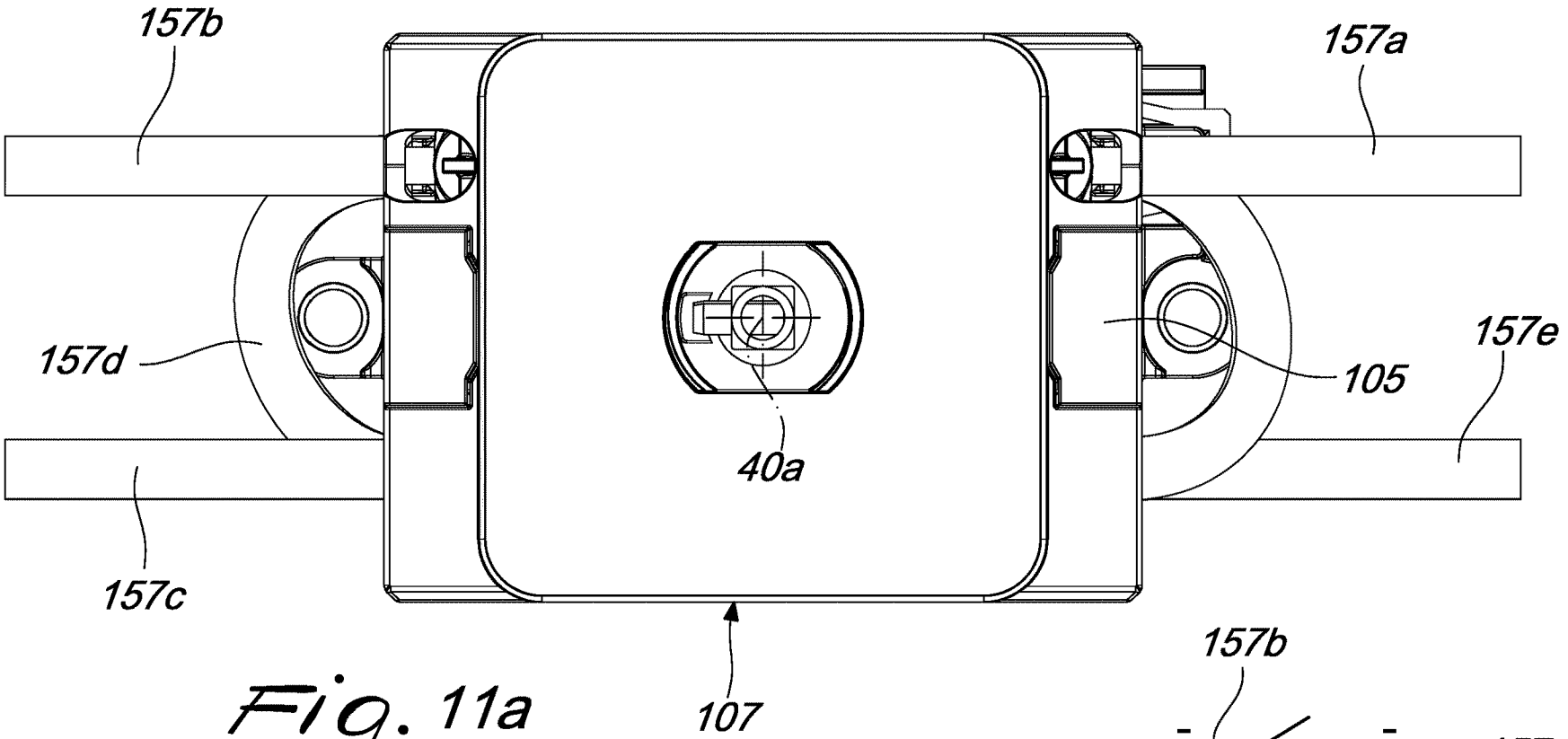
FIG. 11*a* is a plan view from above of the disconnector of FIG. 8.
Figure 11B:
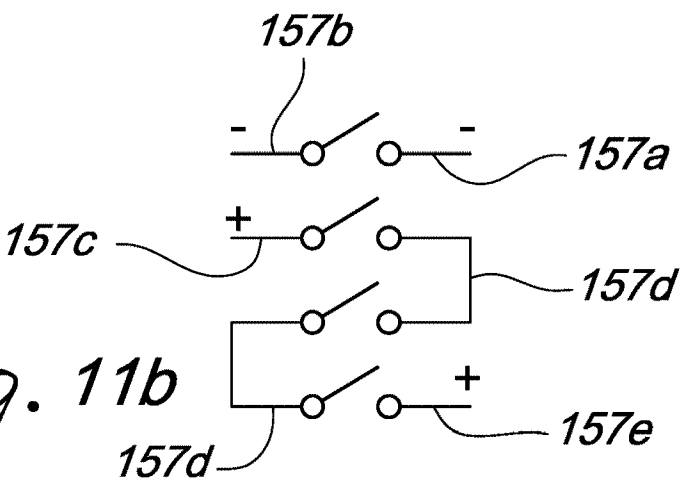
FIG. 11*b* is an electrical diagram of each circuit of the disconnector of the previous figure.
Figure 12:
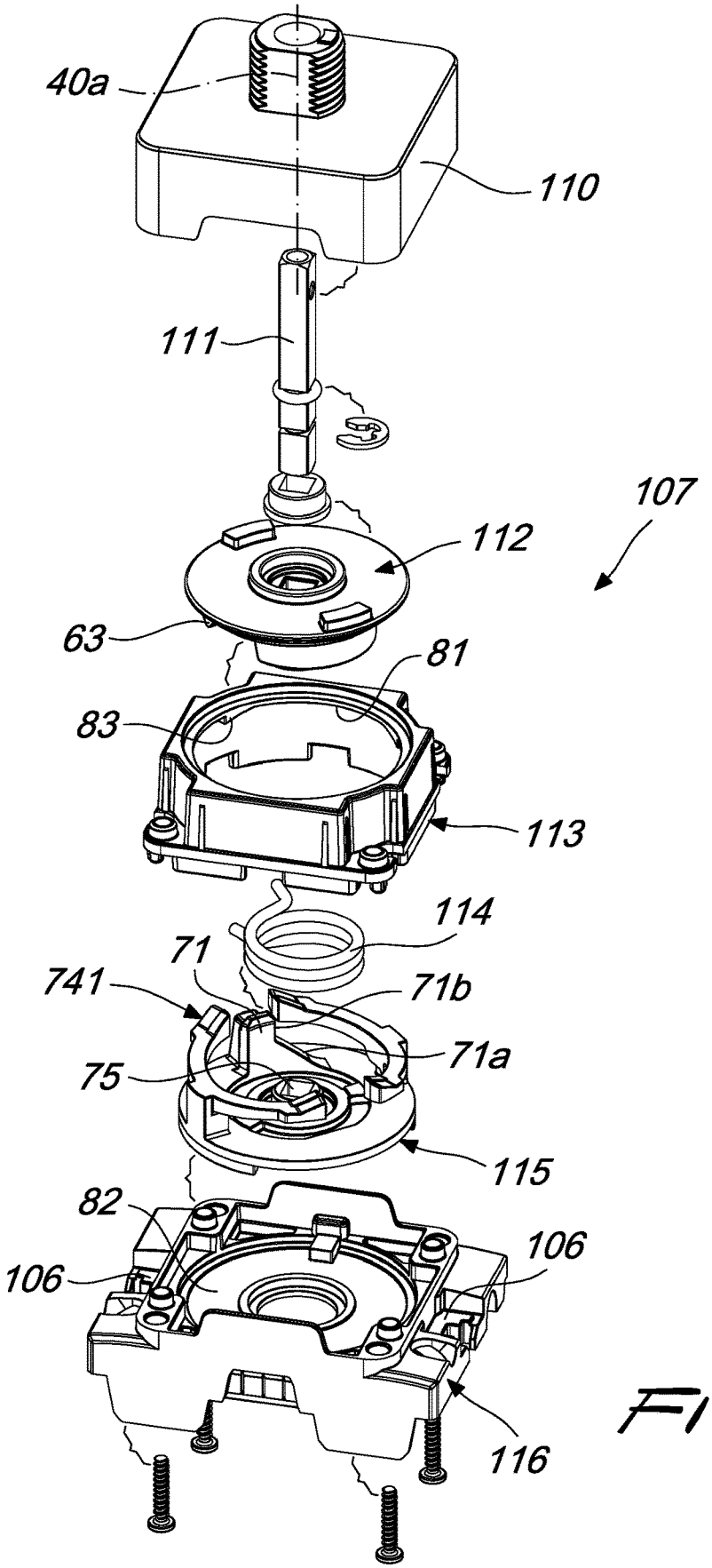
FIG. 12 is an exploded view of the snap-action switch box of the disconnector of FIG. 1.
Figure 13:
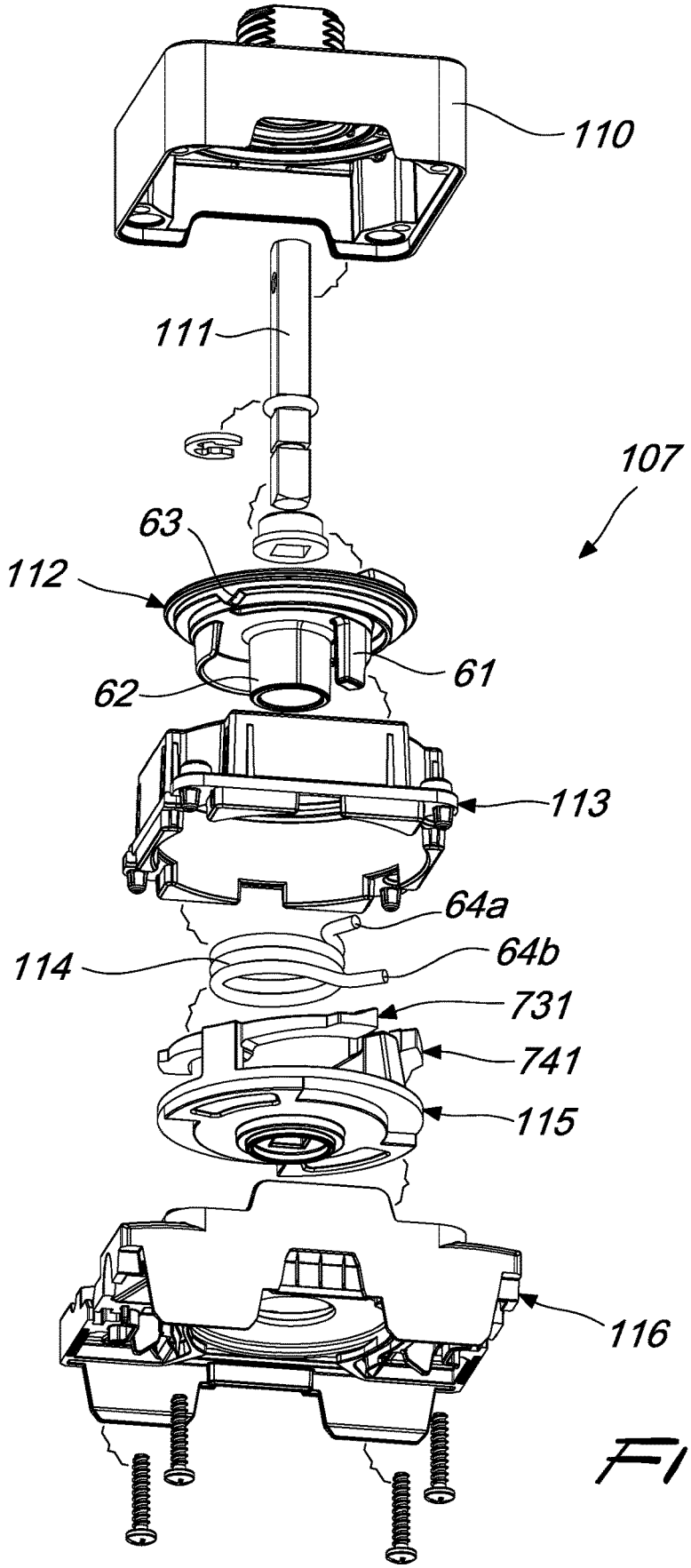
FIG. 13 is a view of the exploded disconnector of the previous figure, from a different perspective.
Figure 14:
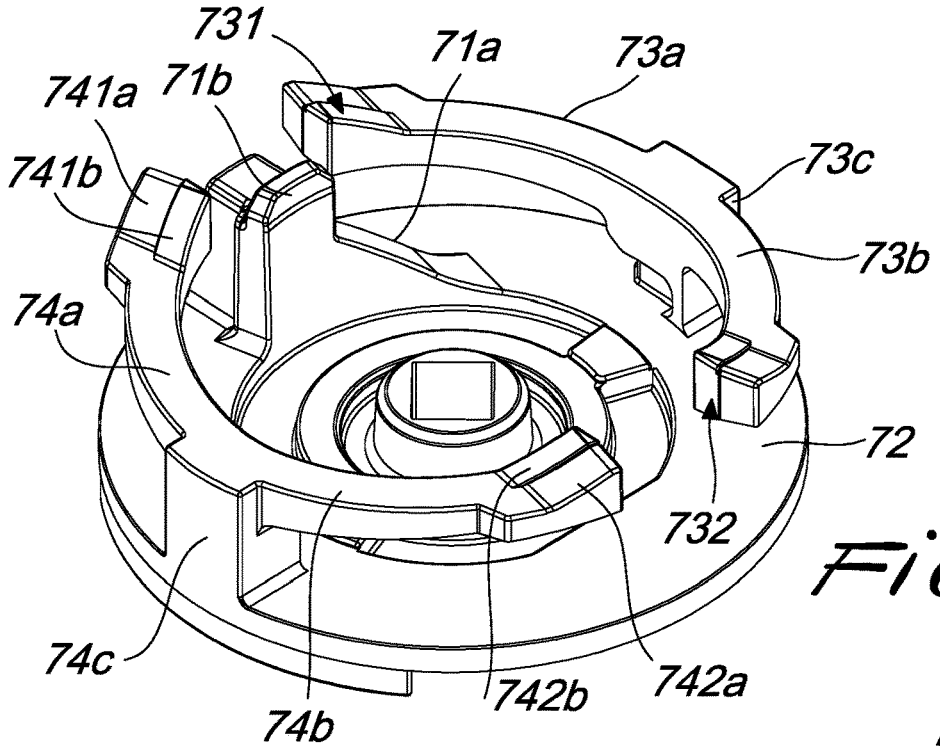
FIG. 14 is a perspective view of the driven indexing element of the snap-action switch box of the previous figure.

In the first example of electrical connection (FIGS. 5, 6, 7*a*, 7*b*) the electrical conductors outside each circuit are electrical cables indicated with 57*a*, 57*b*, 57*c*, 57*d*, 57*e* and are such as to provide, on one face of the disconnector 1, a pair of positive poles and one negative pole for each circuit (for a total of four circuits in the case of twelve contact boxes, in FIG. 5).

Advantageously, the electrical cable 57*d* that directly connects (short-circuits) two connecting portions 51 of two contiguous modules to each other is also completely outside the disconnector 1, differently from the conventional solutions above mentioned. This externally-directed connection of the disconnector facilitates the setup of the desired circuits with a same pre-assembled disconnector 1 without cables and allows the substitution of any damaged electrical cables 57*d* when the disconnector 1 is already installed.

In an alternative circuit implementation, also illustrated by way of example in FIGS. 8-10 and 11*a*-11*b*, the external electrical cables 157*a*-157*e* are arranged so as to connect directly in series three contiguous contact boxes (2*b*-2*c*-2*d*; 2*f*-2*g*-2*h*; 2*j*-2*k*-2*l*) in order to provide one positive and one negative pole, alternating, on both the faces of the disconnector from which the connecting portions 51 are accessible.

The rotary contact 4 comprises a metal conducting portion 41 which defines two electrical end portions 42, preferably in the form of terminals or blades and adapted to come into direct electrical contact with the contact portions 52 of the fixed contacts 5 of the respective module, according to their angular position about the axis 40*a*. The metal conducting portion 41 can be interposed between an insulating rotary support 43, which is accommodated in the central seat 40, and a cover 44, which is also preferably made of insulating material. The end portions 42 of the rotary contact 4 protrude partially from this 43 rotary support and from this cover 44.

Each rotary contact 4 comprises a central through hole 45, which is coaxial with the rotation axis 40*a* common to all the modules 2*a*-21 when the rotary contact 4 is mounted in the central seat 40 of the respective contact box of the stack 2.

The through hole 45 is contoured so as to have a shape complementary to that of a single actuation rod 60 that passes through all of the stack 2 coaxially with the rotation axis 40*a* of the rotary contacts 4, so as to have a shape coupling between the rod 60 and the holes 45 that is substantially free from play. In the preferred embodiments of the disclosure, the shape of the central hole 45 and the shape of the actuation rod 60 is substantially prismatic, for example parallelepiped.

The actuation rod 60 is provided in a single piece, made of metallic or polymeric material. In the preferred embodiments, the single-piece actuation rod 60 is constituted by composite material, for example a polyamide (possibly semi-aromatic or PPA) loaded with glass fibers, for example for 60% by weight. It is possible however to provide, as an alternative, an actuation rod 60 made entirely of metal, optionally covered in electrically insulating material.

In alternative embodiments, not shown, the actuation rod 60 can be constituted by a plurality of rod-like modules which are fixed rigidly and coaxially to each other so as to form a single actuation rod 60. Each one of these rod-like modules is provided in a single piece (for example made of the same materials mentioned above with reference to the single-piece actuation rod) and is rotationally fixed to at least two respective rotary contacts 4 of the two adjacent modular contact boxes that the rod-like module passes through coaxially with the central axis 40*a*. The fixing of the single rod-like module to the two or more rotary contacts 4 occurs preferably in a manner similar to the example shown above, i.e. with a shape coupling between the rod-like module and the holes 45 of the two or more adjacent rotary contacts. In this manner, it is possible to provide disconnectors of different dimensions, by composing the rod-like modules in order to obtain a single actuation rod 60 of suitable length for the desired disconnector.

The actuation rod 60 is coaxial with a drive shaft 111 of the snap-action switch box 107 and is adapted to rigidly transmit the rotation transmitted by the snap-action switch box 107 to all the rotary contacts 4. By virtue of the use of a single actuation rod 60 shared by all the rotary contacts 4, which are rotationally secured thereto preferably through a shape coupling, the speed of response of the rotary contacts 4 to the rotation imparted by snap action through the switch box 107 is considerably improved, even in presence of a large number of modules in the stack 2. For example, in the embodiment illustrated with twelve contact boxes 2*a*-21, it has been found that the rotation delays of the rotary contacts to the ON position are of the order of one-tenth of a degree, while in a structure like that of the prior art patent EP2853012, which does not have a common actuation rod, the delays of the contact boxes furthest from the snap-action switch box can be of the order of 4° and more.

Figure 19:
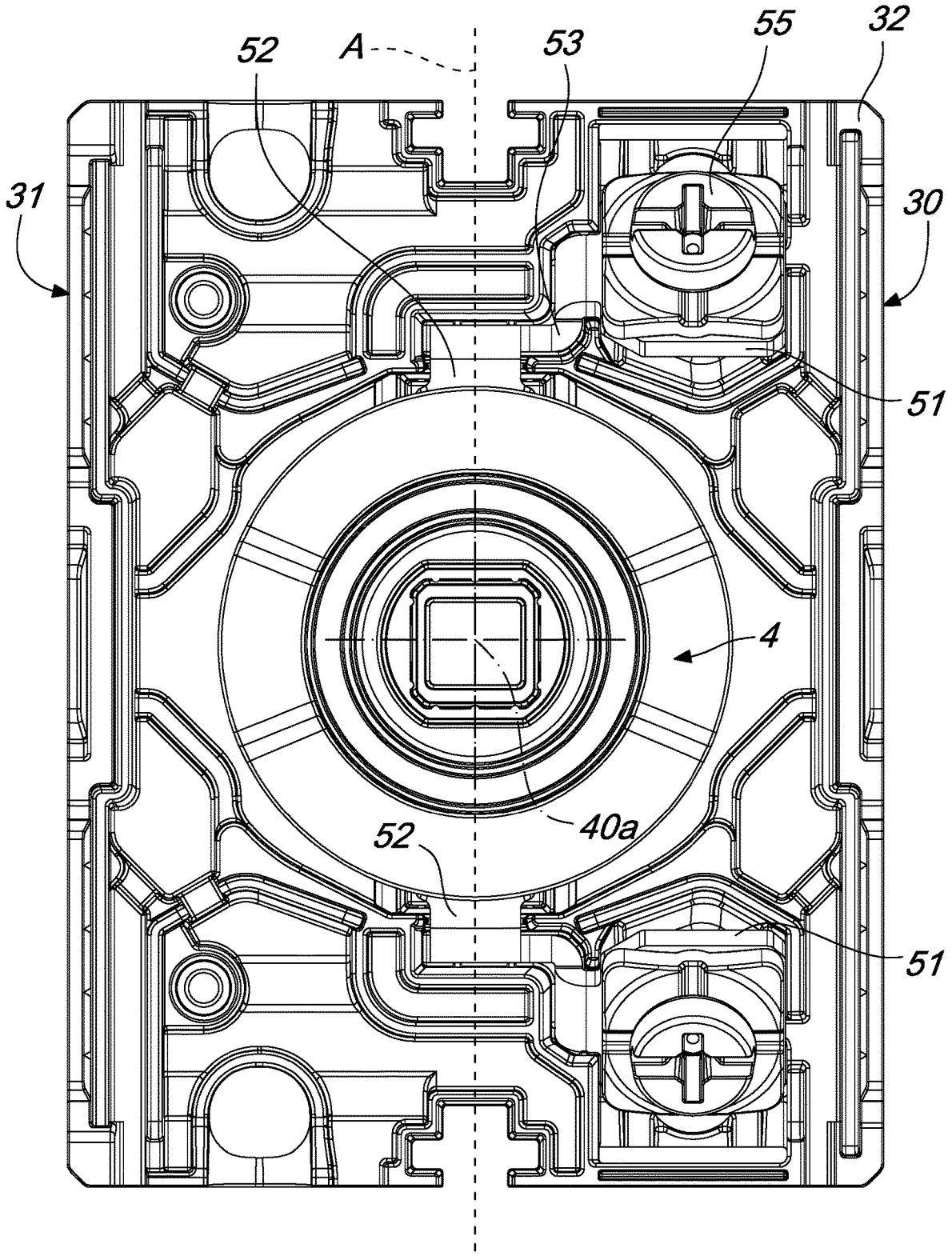
FIG. 19 is a plan view from above of a contact box, or module, of the disconnector of FIG. 1.
Figure 20:
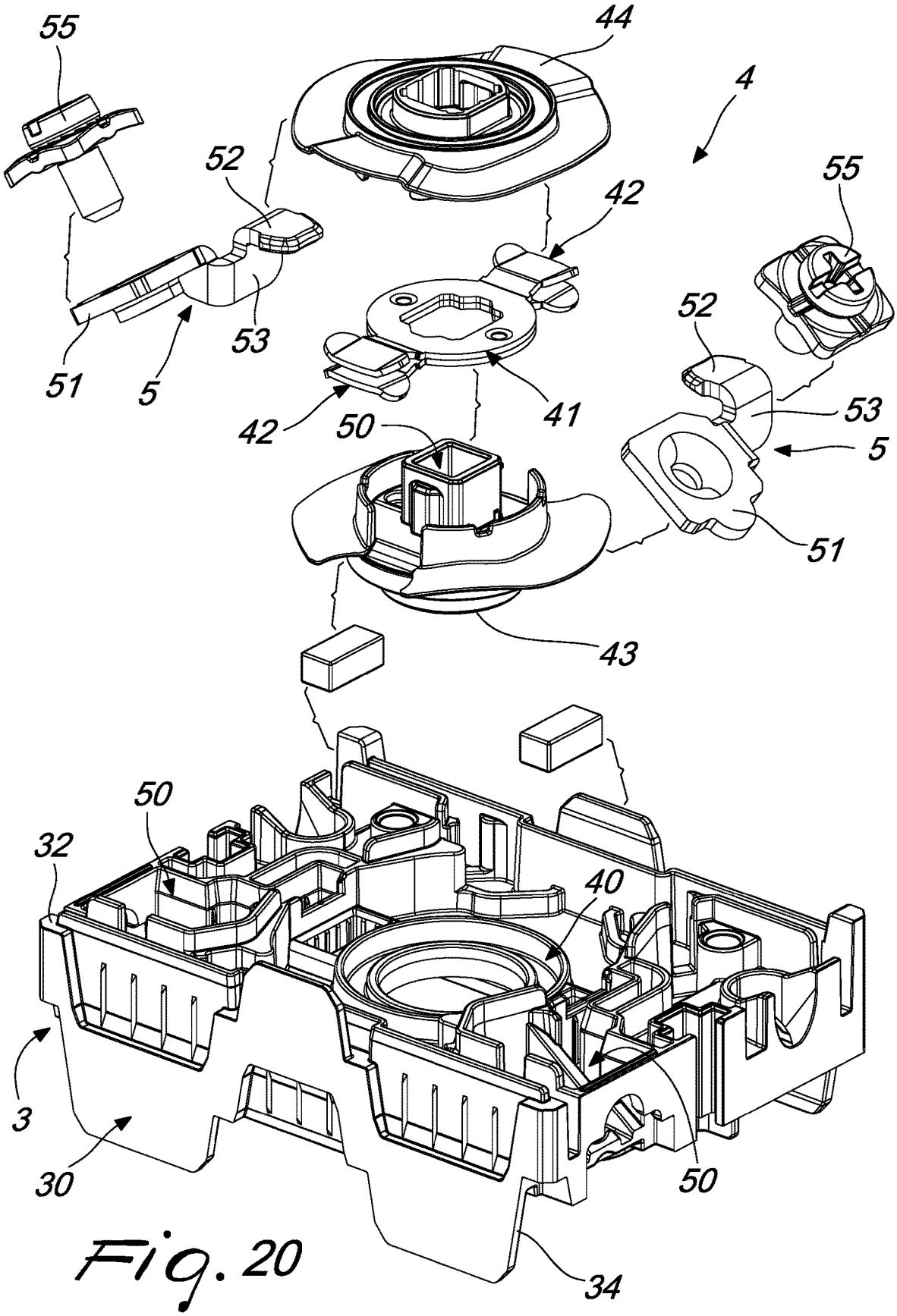
FIG. 20 is an exploded perspective view of the contact box of the previous figure.

FIG. 19 shows one of the modular contact boxes 2*a*-2*k* which are identical to each other but are mounted each rotated 180° with respect to the next one in the stack 2. This contact box has the electrical contacts in the "OFF" configuration, in which the end portions 42 of the rotary contact 4 are not in contact with the contact portions 52 of the fixed contacts 5 (but are at an angular distance of 90° with respect to the axis 40*a*), thus preventing the flow of electric current between the two fixed contacts 5.

According to another advantageous aspect of the disclosure, the snap-action switch box 107 of the disconnector 1 comprises a spring-loaded switching structure in which the elements that slide against each other, by means of which the spring is loaded/released, are made of plastic or polymeric material.

The snap-action switch box 107 comprises, in particular, a covering element 110 which is passed through axially by the drive shaft 111. The drive shaft 111 is rigidly connected to a spindle loading support 112 of a spring 114, which is preferably a torsion spring, for example of the helical type with arms that protrude transversely with respect to the turns of the spring.

The spindle loading support 112, which is contained vertically by the covering element 110 so as to be able to rotate about the axis 40*a*, can be made of polymeric material, preferably composite or reinforced with glass fibers or balls. Advantageous polymeric materials can be polyamide (for example, PA66 or polyamide 66) or the polyoxymethylene.

The spindle loading support 112 is preferably shaped like a circular disk with axial protrusions, is perforated centrally in order to allow an integral rotational coupling with the drive shaft 111 and is provided, on the face opposite to the face from which the drive shaft 111 protrudes, with a first eccentric contrasting wall 61, with a spindle body 62 and with one or more release teeth 63.

Preferably the release teeth 63 are two in number and are arranged in diametrically opposite positions with respect to the central axis of the support 112, while the first eccentric contrasting wall 61 is arranged at an angular distance of substantially 90°, measured with respect to the center of the circular disk, from each release tooth 63.

The first eccentric contrasting wall 61 can have a reinforcement ramp 61*a* and an abutment step 61*b*.

The spindle body 62, which can be substantially cylindrical as in the example shown, is coaxial with the rotation axis 40*a* and is adapted to freely support the spring 114 so as to allow the torsion thereof.

In particular, the spring 114 is freely fitted over the spindle body 62 and has a first end 64*a* directed transversely to the direction toward which the wall for contrasting 61 extends, for example, directed radially with respect to the spring 114.

The first end 64*a* of the spring 114 faces laterally toward the eccentric contrasting wall 61, in particular it faces toward the base of the wall 61 and toward the opposite side with respect to the ramp 61*a*, so as to abut against the wall 61 during the rotation of the spindle loading body 112 in a direction of loading the spring 114, for example clockwise in the case of the disconnector 1.

Preferably, the second end 64*b* of the spring 114 is angularly and axially spaced apart from the first end 64*a* and faces, in the resting condition of the spring, onto the abutment step 61*b* located at the summit of the ramp 61*a*. In its resting condition, the spring 114 can optionally be preloaded.

The second end 64*b* of the torsion spring 114 further abuts against a second eccentric contrasting wall 71 which protrudes from a driven indexing element 115.

The driven indexing element 115 is rotatably associated with the spindle loading support 112 so as to be able to rotate with respect to the latter about the central axis 40*a*, passing centrally through the driven element 115.

The driven element 115 has a circular base 72, which is adapted to rotate in a guided manner about the central axis 40*a* within a corresponding annular seat 82 of the base 116 of the snap-action switch box 107.

The second eccentric contrasting wall 71 protrudes from the disk-like base 72 in an eccentric position and toward the spindle loading support 112 so that, in the resting condition of the spring 114, the contrasting walls 61 and 71 are facing toward each other in a radial direction. In the embodiment illustrated, the radial distance of the second contrasting wall 71 with respect to the rotation axis 40*a* is greater than that of the first contrasting wall 61, but it is also possible to have an opposite positioning in other embodiments.

The second eccentric contrasting wall can also comprise a reinforcement ramp 71*a* and a step 71*b*, but in the assembled structure the ramp 71*a* extends away from the step 71*b* in a direction opposite to that in which the ramp 61*a* of the first wall 61 extends away from the respective step 61*b*.

In the resting condition, the protruding ends 64*a*-64*b* of the torsion spring 114 face toward the sides of both the contrasting walls 61 and 71, so that the spring 114 fitted over the spindle body 62 is substantially across both the contrasting walls 61 and 71.

In a central position, the disk-like base 72 comprises a contoured hole 75 shaped complementarily to the outer shape of the actuation rod 60 of the rotary contacts 4, so as to enable a shape coupling that makes the driven indexing element 115 and the rod 60 integral in rotation. The rod 60 can also be fixed centrally to the driven element 115 in a manner different from shape coupling.

The driven indexing element 115 further comprises a plurality of indexing arms, in particular two pairs of indexing arms 73*a*-73*b* and 74*a*-74*b*.

The pairs of indexing arms 73*a*-73*b* and 74*a*-74*b* of the driven element 115 are elastically flexible in the axial direction, i.e. substantially parallel to the axis 40*a*, and protrude in a cantilever fashion from respective posts 73*c* and 74*c* which protrude from the disk-like base 72.

Preferably, the pairs of indexing arms 73*a*-73*b* and 74*a*-74*b* have substantially the shape of an arc of circumference which, starting from the respective post 73*c*, 74*c*, extend progressively away from the disk-like base 72 without remaining parallel to the disk-like base 72, i.e. without having surfaces parallel to this base 72.

For example, each indexing arm 73*a*, 73*b*, 74*a*, 74*b* extends away from the respective post 73*c*, 74*c* following a segment of a respective helix coaxial with the axis 40*a* of the driven element 115. In particular, the diametrically opposite arms 73*a* and 74*b* can follow a segment of a respective dextrorotatory helix and the diametrically opposite arms 73*b* and 74*a* can follow a segment of a respective levorotatory helix.

Figure 15:
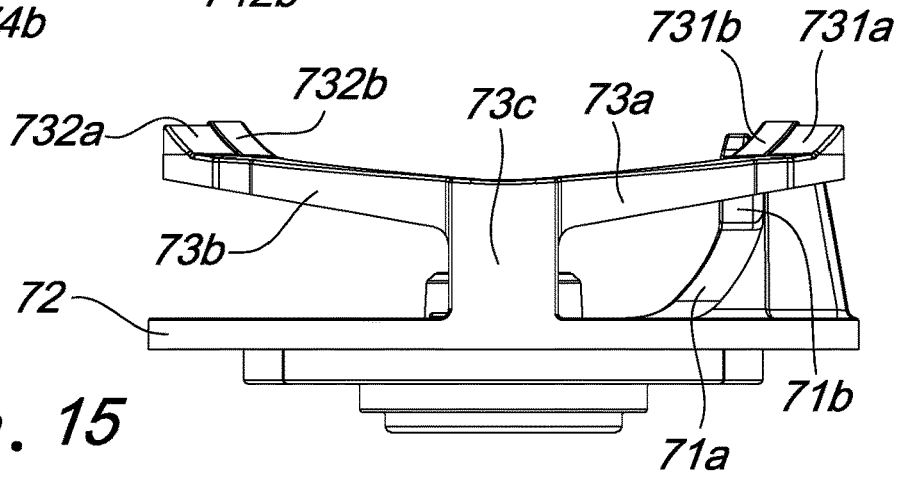
FIG. 15 is a first side view of the driven element of the previous figure.
Figure 16:
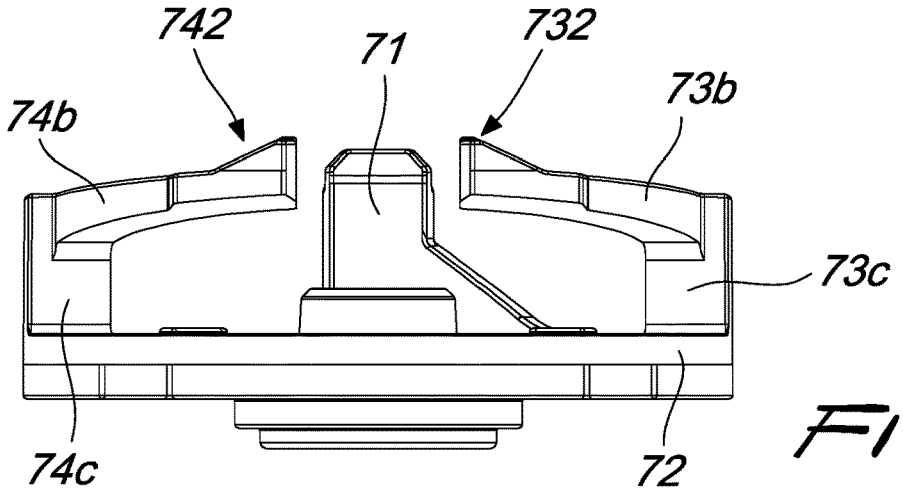
FIG. 16 is a second side view of the driven element of FIG. 14.
Figure 17:
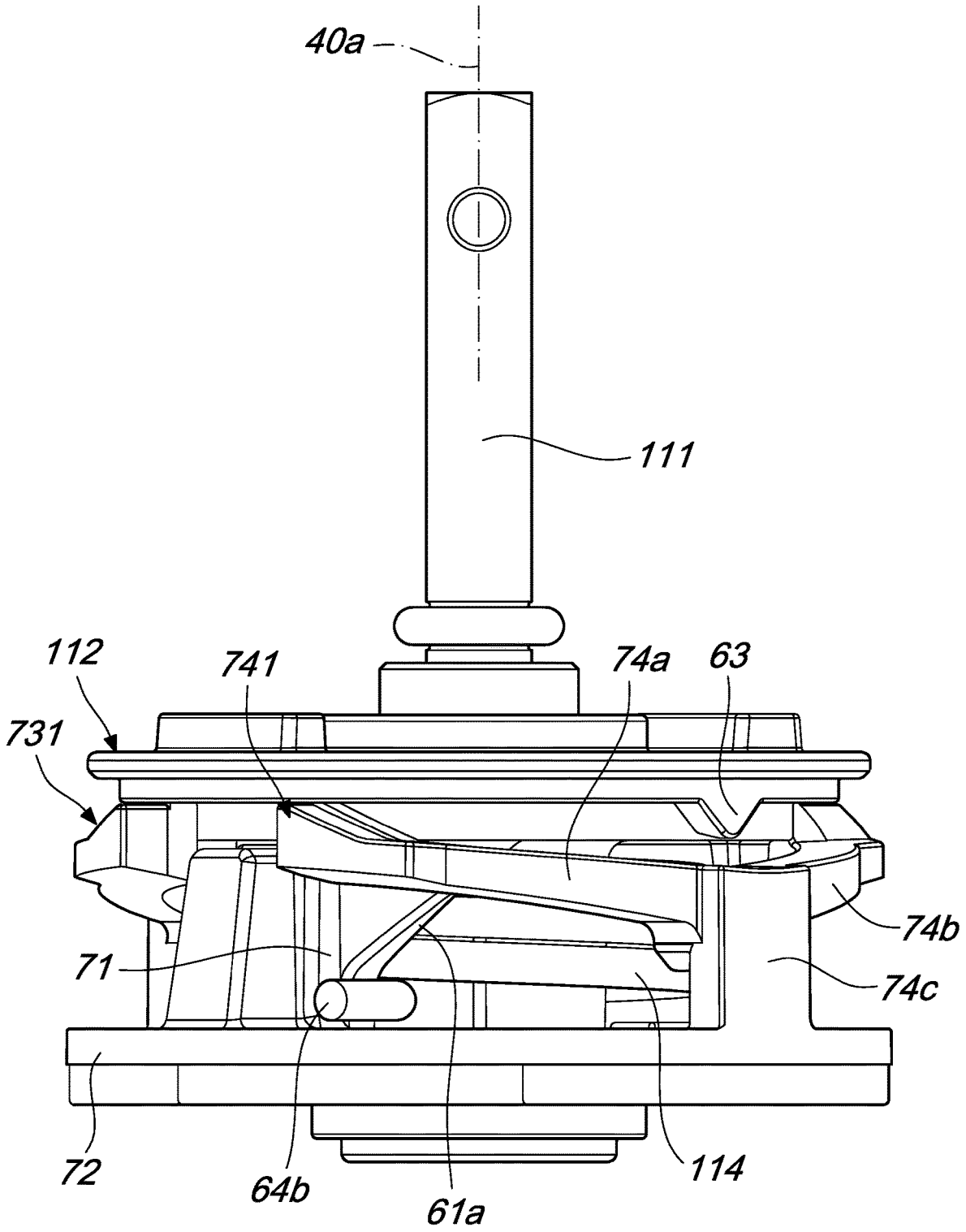
FIG. 17 is an assembly of the loading support, of the driven element and of the torsion spring of the snap-action switch box of FIG. 12.
Figure 18:
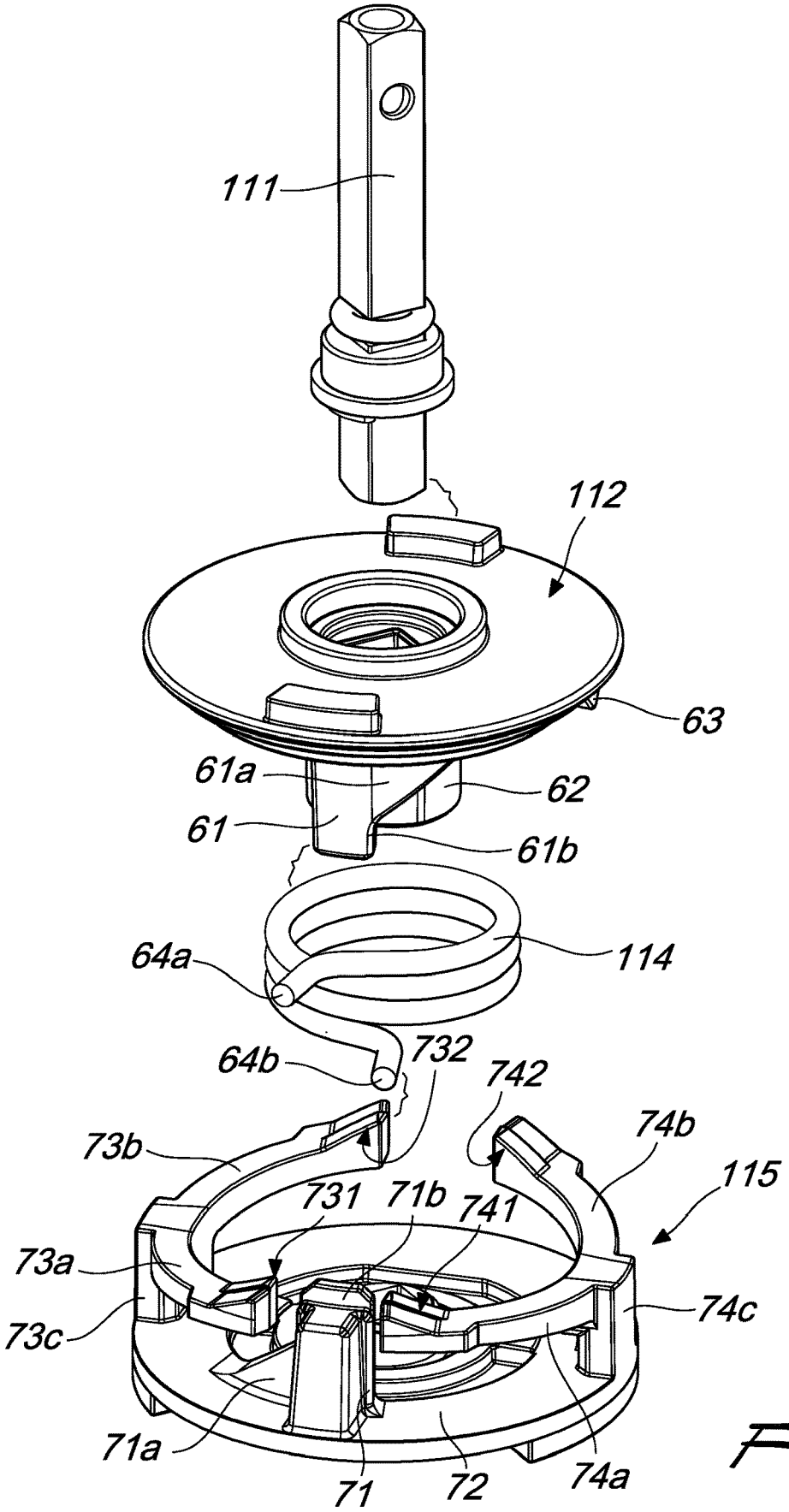
FIG. 18 is an exploded view of the previous figure.

The indexing arms 73*a*, 73*b*, 74*a*, 74*b* form preferably two C-shapes, sloping (for example between 5° and 10°) with respect to the disk-like base 72, as can be seen in particular from FIG. 15, and are substantially mirror-symmetrical with respect to a diametrical plane that passes through the second contrasting wall 71 and the rotation axis 40*a*.

The posts 73*c* and 74*c* are arranged in diametrically opposing peripheral positions of the disk-like base 72 and protrude in the same direction as the second contrasting wall 71, from which they are spaced apart by an angle of substantially 90°. With this arrangement, the second contrasting wall 71 can be substantially interposed between the ends of two indexing arms 73*a*-74*a* that face toward each other.

Each C-shaped pair of arms 73*a*-73*b* and 74*a*-74*b* is integral with the respective post 73*c*, 74*c* at its center.

The spindle loading element 112 is advantageously mounted on the indexing element 115 so that the two release teeth 63 are superimposed, in the resting condition of the spring 114, on the posts 73*c* and 74*c*, respectively.

Each indexing arm 73*a*, 73*b*, 74*a*, 74*b* comprises, at its free end, at least one detent pawl 731, 732, 741, 742, obtained by way of an increase in thickness, preferably progressive, in the axial direction of the respective arm 73*a*, 73*b*, 74*a*, 74*b*, away from the disk-like base 72, i.e. toward the spindle loading element 112.

Each detent pawl 731, 732, 741, 742 comprises an upper sliding surface adapted to block the release teeth 63 during the rotation of the spindle loading support 112 with respect to the driven element 115, causing the lowering of the respective arm 73*a*, 73*b*, 74*a*, 74*b* toward the disk-like base 72, as explained below.

According to an advantageous aspect of the disclosure, the driven indexing element 115 is made of polymeric material, preferably different from the material with which the spindle loading support 112 is made. The polymeric material of the driven element 115 is advantageously a composite or reinforced material, for example with glass fibers or balls.

The polymeric material can be, for example, a polyamide, like PA6 (polyamide 6). The PA6 used to make the driven element 115 can be strengthened with glass fibers or glass balls, preferably between 30% and 60% by weight, for example with 30%, 50% or 60% by weight of glass fibers/balls.

The driven indexing element 115 is contained in the axial direction by a positioning element 113, which is fixed to the base 116 of the snap-action switch box 107 so as to allow the partial rotation of the driven element 115 about the axis 40*a*.

The positioning element 113 can be made of polymeric material which can optionally be reinforced, such as, for example, polyoxymethylene, and preferably chosen to be different from the polymeric material with which the driven element 115 is made.

The positioning element 113 comprises a circular opening provided with an indexing ring 81 which is coaxial with the axis 40*a*, which has an internal radius preferably greater than that of the circular disk of the loading support 112 and smaller than the maximum radial distance of the detent pawls 731, 732, 741, 742 with respect to the axis 40*a*.

The indexing ring 81 has a diameter sufficient to axially contain the driven element 115 within the positioning element 113 and to allow the interaction of the detent pawls 731, 732, 741, 742 of the driven element 115 with the release teeth 63 of the loading support 112.

With the rotation imposed on the spindle loading support 112, the release teeth 63 can thus rotate about the axis 40*a* within the circular opening defined by the indexing ring 81, through which the release teeth 63 can block the detent pawls 731, 732, 741, 742 of the driven element 115.

The indexing ring 81 comprises indexing teeth 83 arranged in diametrically opposite positions, so as to define only four stop points of the rotation of the driven element 115 about the axis 40*a* in at least one direction of rotation.

Each indexing tooth 83 is substantially a ratchet tooth, so as to present a ramp and abutment surface on the flank of the indexing tooth 83, the flank preferably extending on a plane of arrangement of the axis 40*a*.

The indexing teeth 83 are preferably four in number and are arranged along the ring 81 substantially on opposite sides with respect to the central plane A of the modules 2*a*-21 of the disconnector 1, so that one pair of indexing teeth 83 is in a diametrically opposite position from the other pair of indexing teeth, and so that the flanks of the indexing teeth 83 of each one of such pairs face each other mirror-symmetrically with respect to the above mentioned central plane A.

Each arc of the indexing ring 81 comprised between the two mutually-facing flanks of a pair of indexing teeth advantageously has an extension such that it contains a detent pawl 731, 741, 732, 742 of the driven element 115, with the indexing arms 73*a*-74*a*, 73*b*-74*b* in the resting condition or preloaded condition. With the arms in these conditions, a rotation of the driven element 115 about the axis 40*a* is prevented by the side of the respective indexing tooth 83 on which two diametrically-opposite detent pawls 731-742, 732-741 abut.

The abutment flank of each indexing tooth 83 can be abutted by the front part of two respective detent pawls (731-742 or 732-741) which are located at a diametrically opposite position on the driven element 115 and which have, therefore, the normal of the plane of their front part with a direction substantially matching a same direction of rotation of the driven element 115 (anticlockwise for the pawls 731 and 742, clockwise for the pawls 732 and 741).

Preferably, the thickness of the detent pawls 731, 732, 741, 742 in a radial direction is such as to enable, with the relative rotation between the driven element 115, the loading support 112 and the positioning element 113, the interaction of the detent pawls 731, 732, 741, 742 both with the release teeth 63 (during the release of the click) and with the indexing teeth 83 on the indexing ring 81 (during the loading of the spring 114 and the arrest of the rotation subsequent to the click). In particular, two different portions 731*a*-731*b*, 732*a*-732*b*, 741*a*-741*b*, 742*a*-742*b* of the detent pawls 731, 732, 741, 742 are engaged, respectively: a radially innermost pawl 731*a*, 732*a*, 741*a*, 742*a* can engage the release teeth 63, and a radially outermost pawl 731*b*, 732*b*, 741*b*, 742*b* can engage the indexing teeth 83.

Operation of the disconnector according to the disclosure is clear and evident from the foregoing description.

The snap-action switch box 107 is configured so that, in a stable or resting condition, all the rotary contacts 4 of the disconnector 1 are in the ON angular position or in the OFF angular position (as in FIG. 19).

In both these inactive conditions, the mutually-facing detent pawls of the driven element (731-741 and 732-742) are arranged across a respective indexing tooth 83, while the two release teeth 63 of the spindle loading support 112 are kept substantially above the posts 73*c* and 74*c*. The indexing arms 73*a*-74*a*-73*b*-74*b* are all in a resting condition or, in an alternative embodiment, in a preloaded condition (in which case a friction is always maintained between the indexing ring 83 and the detent pawls 731, 741, 732, 742).

By imparting a manual rotation on the drive shaft 111, for example through a handgrip fixed thereto, the spindle loading support 112 is rotated integrally, about the axis 40*a*, and remains substantially idle for a certain portion with respect to the driven element 115 and therefore with respect to the actuation rod 60.

With the above mentioned rotation of the spindle support 112, the first eccentric contrasting wall 61 loads the torsion spring 114 through, for example, the first end 64*a*. In the meantime, the other end 64*b* of the spring 114 is in abutment on the second eccentric contrasting wall 71 without substantially turning the driven indexing element 115, which is stopped by the ratchet system formed by the detent pawls 732-741 and by the respective (flanks of the) indexing teeth 83 against which the spring 114 keeps them in abutment.

When, continuing the manual rotation of the support 112, the release teeth 63 intercept the detent pawls 732-741, these detent pawls are lowered toward the disk-like base 72 until they no longer encounter the resistance of the flanks of the respective indexing teeth 83 and thus freeing the rotation of the driven element 115. The elastic force of the loaded spring 114 that acts on the second eccentric contrasting wall 71 therefore makes the driven element 115 turn very rapidly (for example in 3-5 milliseconds) by 90°, bringing the spring 114 back to the initial condition (resting or preloaded) and bringing the detent pawls 731-742 across the next indexing tooth 83 of the ring 81. With this snap-action rotation, the driven element 115 entrains rigidly with it, by a same angle of approximately 90°, all the rotary contacts 4 of the disconnector 1, in particular by virtue of the single rod 60 that rigidly connects them.

In this manner, the rotary contacts 4 simultaneously click from the ON position to the OFF position (or conversely, depending on the initial position), without there being significant delays or discrepancies between the rotary contacts, even if there is a high number of modules in the disconnector.

Furthermore, by virtue of the plastic materials used to make the elements of the switch box and by virtue of the inclination of the indexing arms of the driven element, it has been found that the switch box is capable of operating reliably even in hot and humid environments.

Among other things, the choice to use different plastic materials for the parts that operate in friction with each other makes it possible to reduce their wear and maintain electrical isolation.

In practice it has been found that the disclosure fully achieves the intended aim and objects.

The disclosure thus conceived is susceptible of numerous modifications and variations, all of which are within the scope of the appended claims. Moreover, all the details may be substituted by other, technically equivalent elements.

What is claimed is:

1. A disconnector comprising: a stack of modular contact boxes surmounted by a snap-action switch box, each modular contact box comprising an accommodation body, each accommodation body having a central seat which accommodates a rotary contact and two peripheral seats, each one of which accommodates a connection portion of a respective fixed contact configured to be accessed from an outside of said modular contact box, said rotary contact being rotatable with respect to said accommodation body about a central axis of said central seat to engage/disengage with respect to the respective fixed contacts, each rotary contact comprising a central hole, the snap-action switch box comprising a driven indexing element rotatably associated with a spindle loading support configured to rotate with respect to said spindle loading support about the central axis, said snap-action switch box further comprising at least one spring connected between said spindle loading support and said driven indexing element in order to load said spindle loading support and said driven indexing element elastically with respect to each other following a mutual rotation about the central axis, wherein the disconnector comprises a single actuation rod which passes through all the modular contact boxes coaxially to the central axis and is fixed in rotation to all the rotary contacts.

2. The disconnector according to claim 1, wherein said actuation rod is provided in a single piece or said actuation rod comprises a plurality of rod modules rigidly fixed to each other to form said actuation rod, each one of said rod modules being provided in a single piece and being rotationally fixed to at least two respective rotary contacts of two adjacent modular contact boxes through which said rod module passes.

3. The disconnector according to claim 1, wherein said actuation rod is engaged in the central hole of said rotary contacts by a shape coupling, so as to render them rotationally integral with the actuation rod about the central axis.

4. The disconnector according to claim 1, wherein said actuation rod includes a composite material.

5. The disconnector according to claim 1, wherein said actuation rod is fixed to the driven indexing element, which is made of electrically insulating material.

6. The disconnector according to claim 1, wherein the two peripheral seats of a same accommodation body are arranged on a same side with respect to a central plane which passes through said central axis, the two peripheral seats of each accommodation body and the two peripheral seats of the accommodation body that is contiguous thereto being arranged on mutually opposite sides with respect to said central plane.

7. The disconnector according to claim 1, wherein the driven indexing element is made of polymeric material, and comprises a plurality of indexing arms which are elastically flexible in a direction that is substantially parallel to the central axis and protrude in a cantilever manner from at least one post which protrudes from a disk base of the driven indexing element toward said spindle loading support.

8. The disconnector according to claim 7, including two posts that protrude from diametrically opposite peripheral positions of the disk base, said indexing arms including two mutually opposite pairs, the indexing arms of each one of said pairs protruding transversely on opposite sides of a same post and having a substantially arc shape which, starting from the respective post, moves progressively away from the disk base of the driven indexing element in an axial direction.

9. The disconnector according to claim 8, wherein the spindle loading support is provided, on a face directed toward the driven indexing element, with a pair of release teeth in positions which are diametrically opposite with respect to the central axis and which substantially face the posts when the spring is in a resting or a preloaded condition, said release teeth being adapted to affect, during rotation of the spindle loading support with respect to the driven element and about the central axis, an upper sliding surface of free ends of the indexing arms so as to push the free ends thus affected towards the disk base.

10. The disconnector according to claim 1, wherein said driven indexing element is contained axially by a positioning element fixed to a base of the snap-action switch box, said positioning element comprising a circular opening provided with an indexing ring coaxial to the central axis, said indexing ring comprising indexing teeth arranged substantially in diametrically opposite positions of the indexing ring with respect to the central axis, so as to define respective stop points of the snap-action rotation of the driven element about the central axis in at least one direction of rotation.

11. The disconnector according to claim 1, wherein the spindle loading support is made of a polymeric material that is different from material the driven indexing element is made of.

* * * * *